US007227092B2

(12) United States Patent
Low et al.

(10) Patent No.: US 7,227,092 B2
(45) Date of Patent: Jun. 5, 2007

(54) DEVICE FOR ACTUATING AN ELECTRIC SWITCHING DEVICE WITH LOCKING DEVICE

(75) Inventors: Kok Kiong Low, Singapore (SG); Wai Luen Eugene Cheong, Singapore (SG); Jean-Marie Periot, Triel-sur-Seine (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 11/279,673

(22) Filed: Apr. 13, 2006

(65) Prior Publication Data

US 2006/0278505 A1 Dec. 14, 2006

(30) Foreign Application Priority Data

Jun. 2, 2005 (FR) ..... 05 51469

(51) Int. Cl.
*H01H 9/28* (2006.01)

(52) U.S. Cl. ..... 200/43.14; 200/43.15

(58) Field of Classification Search ..... 200/43.01, 200/43.08, 43.11–43.16, 50.05, 50.06, 50.11, 200/318, 321, 322, 329, 330, 331, 334, 336
See application file for complete search history.

(56) References Cited

U.S. PATENT DOCUMENTS 3,657,497 A * 4/1972 Homberg et al. ..... 200/50.05
4,851,621 A * 7/1989 Borchardt et al. ..... 200/50.05
5,302,925 A * 4/1994 Castonguay et al. ..... 335/17
5,634,553 A * 6/1997 Hopper et al. ..... 200/336
5,998,743 A * 12/1999 Unkel ..... 200/43.11
6,423,912 B1 * 7/2002 Arenz et al. ..... 200/43.08
6,797,903 B1 * 9/2004 Winslett et al. ..... 200/331
6,969,813 B1 * 11/2005 Winslett et al. ..... 200/330

FOREIGN PATENT DOCUMENTS

DE 196 03 238 C1 4/1997
EP 0 450 699 A2 10/1991
EP 0 774 776 A1 5/1997

OTHER PUBLICATIONS

U.S. Appl. No. 11/279,673, filed Apr. 13, 2006, Low, et al.
U.S. Appl. No. 11/383,285, filed May 15, 2006, Bravard, et al.

* cited by examiner

*Primary Examiner*—Michael A. Friedhofer
(74) *Attorney, Agent, or Firm*—Oblon, Spivak, McClelland, Maier & Neustadt, P.C.

(57) ABSTRACT

An actuation device of an electric switching device includes a body onto which is mounted a rotary control handle and a device for locking the rotation of the control handle making it possible to lock the control handle when the latter is in the "Off" position. The locking device includes a locking member that can move in translation along a main axis, a sliding element mounted on the control handle, that can move in translation along the main axis, and that defines an opening that can receive one or more padlocks in a locked position. The locking device also includes an operating mechanism interacting, on the one hand, with a locking member and, on the other hand, with the sliding element to convert the translation movement of one in a predetermined direction into a translation movement of the other in an opposite direction.

19 Claims, 2 Drawing Sheets

DEVICE FOR ACTUATING AN ELECTRIC SWITCHING DEVICE WITH LOCKING DEVICE

BACKGROUND OF THE INVENTION

1 Field of the Invention

The present invention relates to an actuation device for an electric switching device. The invention relates also to an electric switching device incorporating such an actuation device. The actuation device is, for example, slaved to the electric switching device.

2 Description of the Background

For security reasons, it must be possible to lock the control handle of an actuation device for an electric switching device only when the control handle is in the "Off" position. For this, it is a known practice to provide the actuation device with a device for locking the control handle when the latter is in its "Off" position. In order to keep the control handle in the locked position, padlocks are coupled through one or more openings formed in the control handle.

Document U.S. Pat. No. 6,423,912 describes such an actuation device in which the control handle supports a spring-mounted button masking the openings when it is in the unlocked position. When the control handle is in the "Off" position, a pressure of the button makes it possible to initiate the locking of the control handle but also to clear the openings provided for the passage of the padlocks.

Other locking devices are described in patents U.S. Pat. No. 3,657,497, U.S. Pat. No. 4,032,732 or U.S. Pat. No. 6,596,952.

SUMMARY OF THE INVENTION

The object of the invention is to propose a device for actuating an electric device that is simple to use, compact and low priced.

This object is achieved by an actuation device for an electric switching device comprising a body onto which is mounted a rotary control handle and a device for locking the rotation of the control handle, comprising:

- a locking member that can move in translation along a main axis between a position in which the rotation of the control handle is locked and an unlocked position,
- a sliding element mounted on the control handle, that can move in translation along said main axis and that defines an opening that can receive one or more padlocks in a locked position,
- said locking device being characterized in that it also comprises an operating mechanism interacting, on the one hand, with the locking member and, on the other hand, with the sliding element to convert the translation movement of one in a determined direction into a translation movement of the other in an opposite direction.

According to a first embodiment of the invention, the operating mechanism consists of a rod having a first end fixedly attached to the locking member and a second end fixedly attached to the sliding element.

According to a particular feature of this first embodiment, the rod is mounted so as to rotate on the control handle.

According to another particular feature, the locking member and the sliding element are each mounted so as to slide respectively on the first end and on the second end of the rod.

According to a second embodiment of the invention, the operating mechanism comprises a gear wheel interacting with corresponding teeth formed, on the one hand, on the sliding element and, on the other hand, on the locking member.

Preferably, the locking member comprises a button fixedly attached in translation to the latter, making it possible to actuate the locking device.

Advantageously, the locking member comprises a shank capable of engaging, in the locked position, in a corresponding orifice formed through the body.

Advantageously, a return spring is mounted on the locking member forcing the locking member towards the unlocked position.

Preferably, in the locked position of the control handle, the sliding element protrudes outside the control handle and, in the unlocked position, it is flush with the control handle.

According to a particular feature, the actuation device may comprise a device making it possible to disable the locking device.

According to another particular feature, the actuation device is slaved to the electric switching device and the control handle interacts with a transmission shaft fixedly attached to a rotary movable member of the electric switching device.

The actuation device defined hereinabove is particularly suitable for controlling an electric switching device.

BRIEF DESCRIPTION OF THE DRAWINGS

Other features and advantages will appear in the following detailed description with reference to an embodiment given as an example and represented by the appended drawings in which.

DESCRIPTION OF THE PREFERRED EMBODIMENTS

Figure 1A:
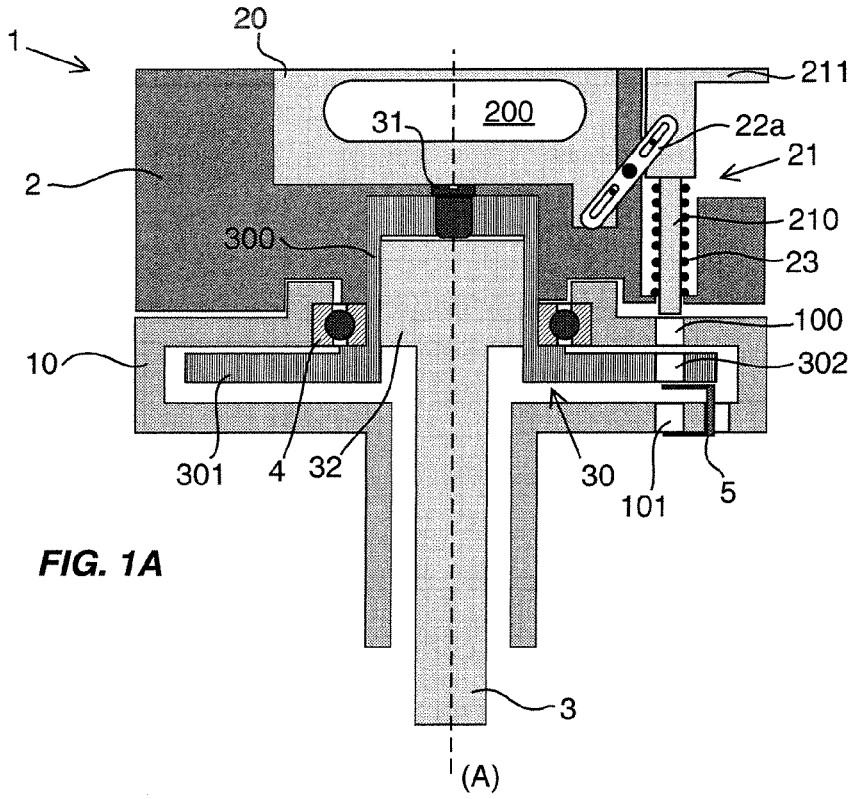
FIGS. 1A and 1B represent schematically the actuation device according to the invention, showing a locking device according to a first embodiment, respectively in a position in which the control handle is unlocked and in a position in which the rotation of the control handle is locked.

Referring now to the drawings, wherein like reference numerals designate identical or corresponding parts throughout the several views.

The actuation device 1 according to the invention is, for example, slaved to the electric switching device and mounted on the door of an electric cabinet in order to allow the operator to operate the electric device without opening the electric cabinet. Such actuation devices are well known in the prior art and are, for example, used for the control of a circuit breaker.

With reference to FIGS. 1A to 2B, a slaved actuation device 1 according the invention comprises a body 10 onto which is mounted a rotary control handle 2 whose rotary movement about a main axis (A) is fixedly attached to that of a transmission shaft 3 responsible for transmitting the movement of the control handle 2 to a rotary member of the electric switching device present in the cabinet, said rotary member controlling the opening or closing of electric contacts in the device. The control handle 2 is attached to a support 30 of the transmission shaft 3 for example with the aid of a screw 31, said shaft support 30 being fixedly attached to the head 32 of the transmission shaft 3 and disposed coaxially with the shaft 3. A ball bearing 4 is positioned coaxially between the body 10 and the shaft support 30 to allow the control handle 2 to rotate relative to the body 10.

The shaft support 30 has the shape of a hat consisting of a cap 300 receiving the head 32 of the transmission shaft 3, extended towards the outside of an annular plate 301.

According to the invention, the actuation device 1 comprises a locking device mounted on the control handle 2 and making it possible to lock the rotation of the control handle 2 when the latter is in its "Off" position. For safety reasons, it must be possible to lock the control handle 2 only when the control handle 2 is in its "Off" position. For this, the locking device comprises a sliding element 20 fixedly attached to the control handle 2 and able to be extracted from the latter and a locking member 21, both movable in translation along the main axis (A) between an unlocked position and a position in which the rotation of the control handle 2 is locked.

The control handle 2 has a housing 24 in which the extractable sliding element 20 is housed. The sliding element 20 includes an opening 200, for example oblong in shape, through which it is possible to pass padlocks in order to prevent the sliding element 20 from returning to its housing 22 and therefore to lock the actuation device 1. This sliding element 20 is movable in translation along the main axis (A). According to a variant embodiment, this opening may be defined between the sliding element 20 and the control handle 2.

In the unlocked position (FIGS. 1A and 2A), the sliding element 20 is flush with the control handle 2 while in the locked position (FIGS. 1B and 2B) it protrudes relative to the control handle 2 in order to clear its opening 200 provided to receive the padlocks.

The locking member 21 comprises a shank 210 that is capable of moving in translation along the main axis (A) and is intended to come to traverse an orifice 100 formed through the body 10 of the device 1. This orifice 100 is opposite the shank 210 only when the control handle 2 is in its "Off" position. Thus, the shank 210 cannot be engaged in this orifice 100 to lock the rotation of the control handle 2 unless the control handle 2 is in the "Off" position. A second orifice 302 is also provided through the shaft support 30, opposite the shank 210. Similarly, a third orifice 101 is provided on another portion of the body 10. This third orifice 101 is situated opposite the shank 210 only when the control handle 2 is in the "Off" position and is situated in the same axis as the orifice 100.

The locking member 21 also comprises a button 211 mounted on the outside of the actuation device, fixedly attached in translation to the shank 210 and allowing the actuation of the locking device. When the control handle 2 is in the "Off" position, a pressure on the button 211 makes it possible to engage the locking device and to engage the shank 210 in the orifice 100 of the body 10. The locking member 21, comprising the shank 210 and the button 211, is fixedly attached in rotation to the control handle 2.

The translation movement of the locking member 21 is accompanied by a corresponding movement of the sliding element 20 using an operating mechanism (22*a*, 22*b*) mounted on the control handle 2. This operating mechanism (22*a*, 22*b*) makes it possible to convert the translation movement of the locking member 21, along the main axis (A) and in a determined direction, into a translation movement of the sliding element 20 along the main axis (A) and in the direction opposite to that of the locking member 21. A pressure on the button 211 of the locking member 21 therefore causes an extraction of the sliding element 20.

The extraction of the sliding element 20 out of the control handle 2 makes it possible to clear its opening 200 in order to be able to allow padlocks (not shown) to pass therein allowing the rotation of the control handle 2 to be locked when the latter is in the "Off" position. If the control handle 2 is not in the "Off" position, the shank 210 of the locking member 21 butts against the body 10 of the device 1 and the extraction of the sliding element 20 from the control handle 2 is impossible or, in any case, insufficient to be able to insert padlocks therein. The second orifice 302 provided through the shaft support 30 and the third orifice 101 also provided through the body 10 allow only the shank 210 to continue its translation during locking and therefore allow the sliding element 20 to be extracted sufficiently to be able to pass padlocks through the opening 200.

Figure 2A:
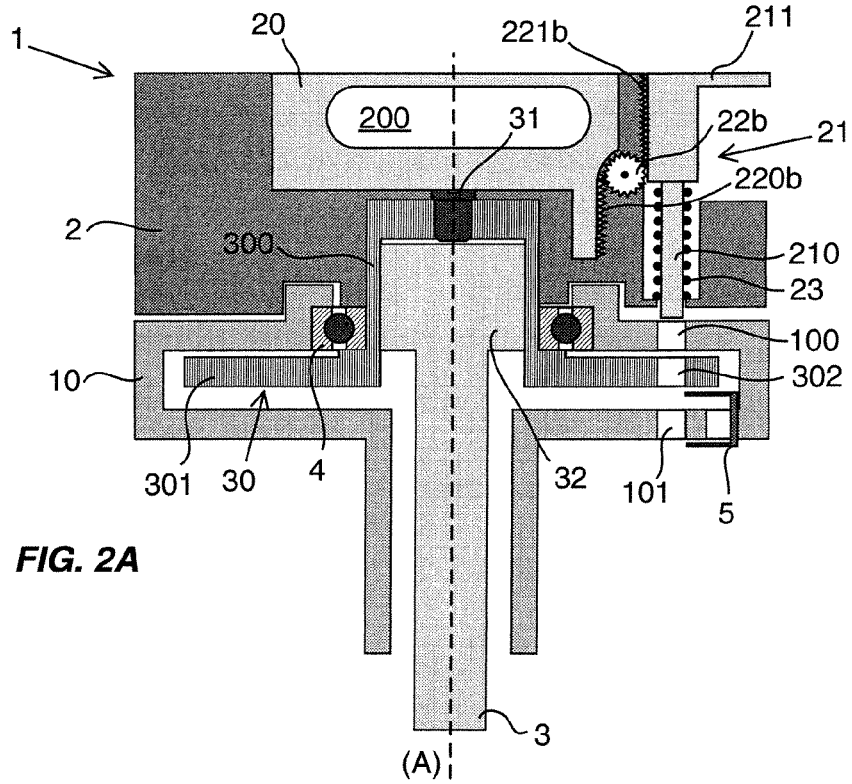
FIGS. 2A and 2B represent schematically the actuation device according to the invention having a locking device according to a second embodiment, respectively in the position in which the control handle is unlocked and in the position in which the rotation of the control handle is locked.

According to a first embodiment of the locking device represented in FIGS. 1A and 2A, the operating mechanism consists of a rod 22*a* mounted so as to rotate on the control handle 2 and having one end fixedly attached to the sliding element 20 and another end fixedly attached to the locking member 21 and more particularly to the button 211 of the latter. The rod 22*a* has, for example at each of its ends, two oblong openings 220 in which the sliding element 20 and the button 211 are mounted. When the control handle 2 is in its "Off" position, a pressure on the button 211 engages the shank 210 in the orifice 100 to lock the rotation of the control handle 2 and also causes a rotation of the rod 22*a* and a movement of the sliding element 20 extracting it from the control handle 2 in order to clear its opening 200 provided for the passage of the padlocks.

Figure 1B:
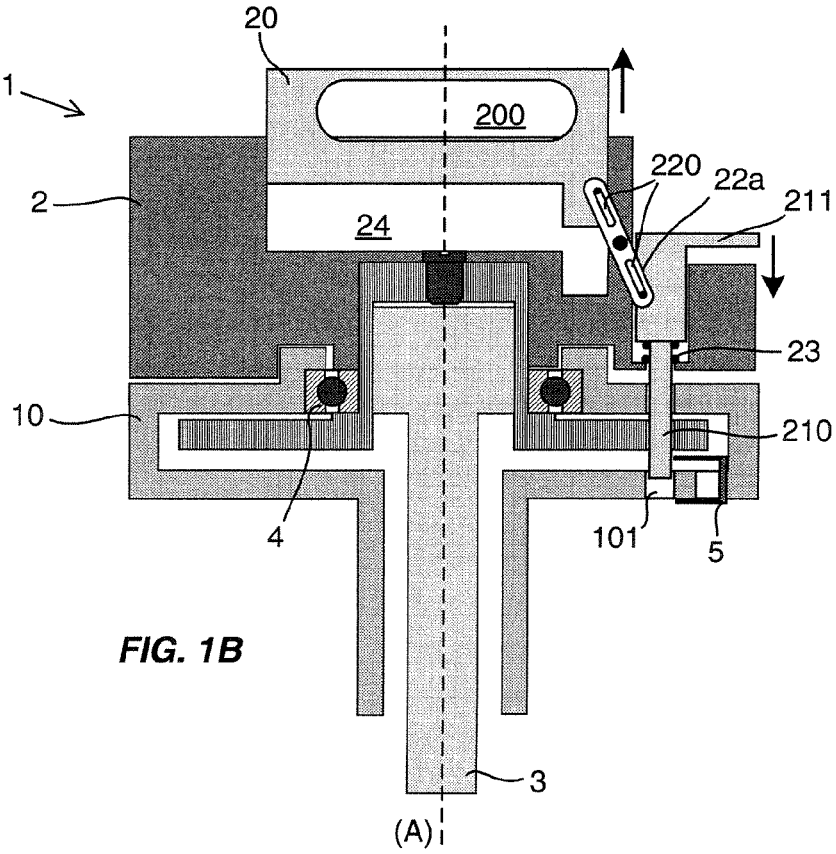
Figure 2B:
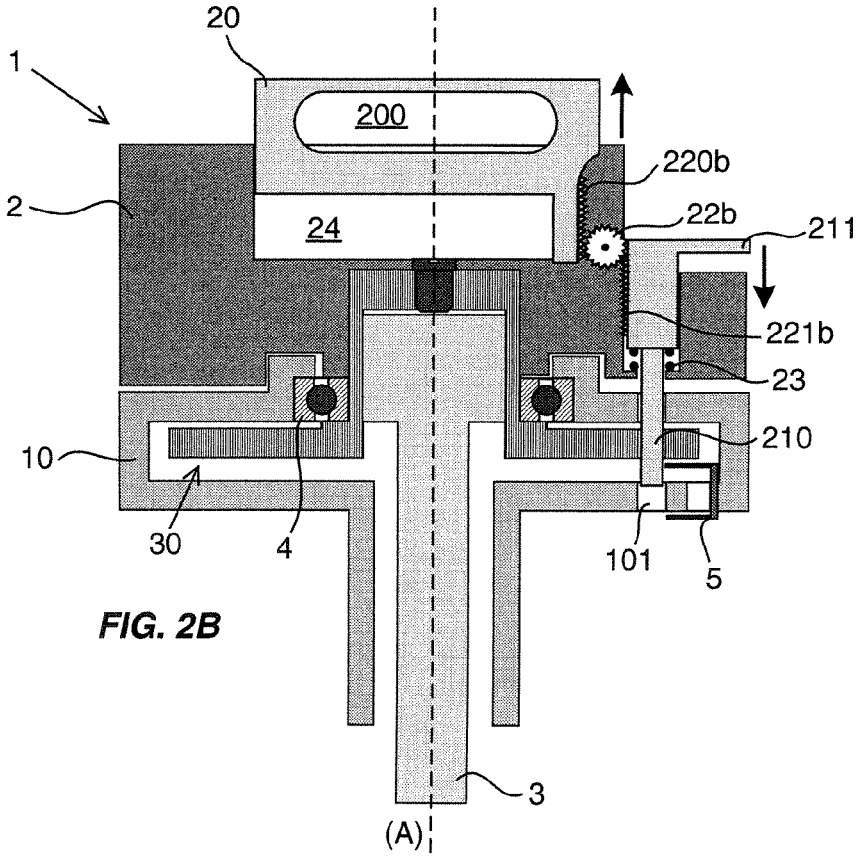

According to a second embodiment of the locking device represented in FIGS. 1B and 2B, the operating mechanism consists of a gear wheel 22*b* mounted so as to rotate on the control handle 2 and interacting with corresponding teeth 220*b*, 221*b* formed, on one side, on the sliding element 20, along the main axis (A), and on the other side, in parallel, on the button 211 of the locking member 21. When the control handle 2 is in the "Off" position, a pressure on the button 211 to lock the rotation of the control handle 2 engages the teeth 221*b* of the button 211 on the gear wheel 22*b* which causes the rotation of the gear wheel 22*b*, the latter causing, in the direction opposite to that of the pressure of the button 211, the extraction of the sliding element 20 making it possible to clear the opening 200 provided for the passage of the padlocks.

According to the invention, the locking member 21 is for example mounted on a spring 23 forcing the button 211 in the unlocked direction and therefore the entry of the sliding element 20 into its housing 24 provided on the control handle 2. The spring 23 is, for example, of the helical type and is placed in a housing of the control handle 2 and around the shank 210 of the locking member. The spring 23 presses at one end against the button 211 and at its other end against the control handle 2.

According to the invention, a device 5 making it possible to disable the locking device can be provided. This device 5 consists of a sliding part, mounted on the body 10 and accessible from the outside of the actuation device 1, coming to interpose itself on the path of translation of the locking member 21 blocking off the passage provided for the shank 210 (FIG. 1A). Thus, the shank 210 cannot be deployed completely during locking; the sliding element 20 is then insufficiently extracted to be able to pass padlocks through.

It is well understood that the operating mechanism 22*a*, 22*b* interacts with the locking member 21 and with the sliding element 20 and makes it possible to convert the translation movement of one in a determined direction into a translation movement of the other in the opposite direction. Thus, according to a variant embodiment, the locking member 21 may be actuated not by pressing the button 211 but by extracting the sliding element 20.

It is well understood that, without departing from the scope of the invention, it is possible to imagine other variants and enhancements of detail and even to envisage the use of equivalent means.

The invention claimed is:

1. An actuation device for an electric switching device comprising a body onto which is mounted a control handle and a locking device configured to lock a rotation of the control handle, said locking device comprising:

a locking member configured to move in a locking translation movement along a main axis in a locking direction between a locked position in which the rotation of the control handle is locked and an unlocked position;

a sliding element mounted on the control handle and configured to move in a sliding translation movement along said main axis in a sliding direction opposite to the locking direction and define an opening that can receive one or more padlocks in a locked position; and an operating mechanism configured to interact with the locking member and with the sliding element to convert the sliding translation movement of the sliding element in the sliding direction into the locking translation movement of the locking member in the locking direction, and convert the locking translation movement of the locking member in the locking direction into the sliding translation movement of the sliding element in the sliding direction.

2. The actuation device according to claim 1, wherein the operating mechanism includes a rod having a first end fixedly attached to the locking member and a second end fixedly attached to the sliding element.

3. The actuation device according to claim 2, wherein the rod is mounted so as to rotate on the control handle.

4. The actuation device according to claim 2 or 3, wherein the locking member and the sliding element are each mounted so as to slide respectively on a first end and on a second end of the rod.

5. The actuation device according to claim 1, wherein the operating mechanism comprises a gear wheel configured to interact with corresponding teeth formed on the sliding element and, on the locking member.

6. The actuation device according to claim 1, wherein the locking member comprises a button fixedly attached to a shank, and configured to actuate the locking device.

7. The actuation device according to claim 6, wherein the locking member comprises a shank configured to be located in a corresponding orifice formed through the body when the locking member is in the locked position.

8. The actuation device according to claim 7, wherein a return spring is mounted on the locking member and configured to force the locking member towards the unlocked position.

9. The actuation device according to claim 8, wherein, in the locked position of the control handle, the sliding element protrudes outside the control handle and, in the unlocked position of the control handle, the sliding element is flush with the control handle.

10. The actuation device according to claim 9, wherein a disabling device is configured to disable the locking device.

11. The actuation device according to claim 10, wherein the actuation device is slaved to the electric switching device and wherein the control handle interacts with a transmission shaft fixedly attached to a rotary movable member of the electric switching device.

12. The actuation device according to claim 11, wherein the operating mechanism includes a rod having a first end fixedly attached to the locking member and a second end fixedly attached to the sliding element.

13. The actuation device according to claim 11, wherein the operating mechanism comprises a gear wheel configured to interact with corresponding teeth formed on the sliding element and on the locking member.

14. The actuation device according to claim 1, wherein the locking member comprises a shank configured to be located in a corresponding orifice formed through the body when the locking member is in the locked position.

15. The actuation device according to claim 1, wherein a return spring is mounted on the locking member and configured to force the locking member towards the unlocked position.

16. The actuation device according to claim 1, wherein, in the locked position of the control handle, the sliding element protrudes outside the control handle and, in the unlocked position of the control handle, the sliding element is flush with the control handle.

17. The actuation device according to claim 1, wherein a disabling device is configured to disable the locking device.

18. The actuation device according to claim 1, wherein said actuation device is slaved to the electric switching device and wherein the control handle interacts with a transmission shaft fixedly attached to a rotary movable member of the electric switching device.

19. An electric switching device controlled with the aid of an actuation device, wherein the actuation device comprises a body onto which is mounted a control handle and a locking device configured to lock a rotation of the control handle, the locking device comprising:

a locking member configured to move in a locking translation movement along a main axis in a locking direction between a locked position in which the rotation of the control handle is locked and an unlocked position;

a sliding element mounted on the control handle and configured to move in a sliding translation movement along said main axis in a sliding direction opposite to the locking direction and define an opening that can receive one or more padlocks in a locked position; and an operating mechanism configured to interact with the locking member and with the sliding element to convert the sliding translation movement of the sliding element in the sliding direction into the locking translation movement of the locking member in the locking direction, and convert the locking translation movement of the locking member in the locking direction into the sliding translation movement of the sliding element in the sliding direction.

* * * * *